US006776179B1

(12) United States Patent
Chen

(10) Patent No.: US 6,776,179 B1
(45) Date of Patent: Aug. 17, 2004

(54) QUICK-PITCH/STRIKE TENT

(75) Inventor: Yeong-Shu Chen, 3, Lane 119, Kwangfu St., Shangshan Village, Chionglin Hsiang, Hsinchu Hsien (TW)

(73) Assignees: Yeong-Shu Chen (TW); Sportsman Corporation (TW)

( * ) Notice: Subject to any disclaimer, the term of this patent is extended or adjusted under 35 U.S.C. 154(b) by 0 days.

(21) Appl. No.: 10/388,611

(22) Filed: Mar. 17, 2003

(51) Int. Cl.[7] ..... E04H 15/48

(52) U.S. Cl. ..... 135/147; 135/135; 135/143; 135/144

(58) Field of Search ..... 135/147, 143, 135/144, 139, 141, 135, 145; 403/85, 100, 101; 52/646, 645, 656.9

(56) References Cited

U.S. PATENT DOCUMENTS

| | | | | | |
|---|---|---|---|---|---|
| 1,820,002 | A | * | 8/1931 | Forrester | 135/140 |
| 4,074,682 | A | * | 2/1978 | Yoon | 135/135 |
| 4,195,651 | A | * | 4/1980 | Watts et al. | 135/135 |
| 4,637,748 | A | * | 1/1987 | Beavers | 403/170 |
| 4,966,178 | A | * | 10/1990 | Eichhorn | 135/123 |
| 5,069,572 | A | * | 12/1991 | Niksic | 403/170 |
| 5,328,286 | A | * | 7/1994 | Lee | 403/218 |
| 5,620,272 | A | * | 4/1997 | Sheng | 403/96 |
| 5,651,633 | A | * | 7/1997 | Howe | 403/392 |
| 5,797,695 | A | * | 8/1998 | Prusmack | 403/170 |
| 5,884,646 | A | * | 3/1999 | Ju | 135/135 |
| 6,094,801 | A | * | 8/2000 | Howe | 29/525.01 |
| 6,203,511 | B1 | * | 3/2001 | Johnson et al. | 602/16 |
| 6,629,801 | B2 | * | 10/2003 | Cheng | 403/101 |
| 2002/0092554 | A1 | * | 7/2002 | Ham et al. | 135/135 |

* cited by examiner

*Primary Examiner*—Leslie A. Braun
*Assistant Examiner*—Amy J. Sterling
(74) *Attorney, Agent, or Firm*—Bacon & Thomas, PLLC

(57) ABSTRACT

A quick-pitch/strike tent. The tent includes a frame and a cloth housing suspended on the frame. The frame and the cloth housing are connected together and the frame has multiple poles. Each pole has multiple joints to conveniently pitch or strike the tent. The frame and the cloth housing are connected together so that pitching the tent consists of just erecting the frame. The joints of the poles are conveniently struck so the cloth housing and the frame can be quickly struck for storage and transportation together.

20 Claims, 13 Drawing Sheets

QUICK-PITCH/STRIKE TENT

BACKGROUND OF THE INVENTION

1. Field of the Invention

The present invention relates to a tent, and more particularly to a quick-pitch/strike tent.

2. Description of Related Art

Work and life in modern society are hectic and stressful. Many people go camping on weekends to moderate the pace of their daily life and relieve the stress. A tent is a necessary piece of camping equipment. However, tents can be inconvenient and difficult to set up. Thus, a tent that could be easily erected and taken down needed to be invented.

Conventional "pop-up" tents have been developed and are geodesic domes composed of a frame, a cloth housing and a rain fly. The cloth housing has a canopy, a floor, an inside, an outside and multiple loops strategically positioned on the outside to accommodate the frame. The frame is composed of multiple resilient poles. When people pitch the conventional pop-up tent, they must pass the multiple resilient poles through multiple loops on the cloth housing before they pitch the tent. Each of the poles is resilient and can bend to conform to the tent shape. When the tent is struck, the cloth housing can be folded, and the cloth housing and the poles must be separated to minimize the space occupied. However, passing the poles through the loops on the cloth housing wastes time. Pitching or striking a tent is a necessary part of setting up or striking camp, and most campers want to take as little time as possible to pitch or strike the tent. Furthermore, campers want to use as much of their available time as possible to enjoy nature so quickly pitching or striking the tent adds to the campers' enjoyment.

The present invention has arisen to mitigate or obviate the disadvantages of the conventional tent.

SUMMARY OF THE INVENTION

The main objective of the present invention is to reduce the time required to pitch or strike a tent.

To achieve the objective, a quick-pitch/strike tent in accordance with the present invention comprises a frame and a cloth housing suspended on the frame. The cloth housing has a canopy, a floor, multiple flexible loops, multiple clips and multiple end connectors. The multiple flexible loops on the cloth housing respectively pass through the multiple clips so the cloth housing can be connected to the frame. The end connectors are respectively attached to flexible loops connected to the floor. The frame comprises a crown and multiple poles. Each pole has multiple joints, multiple sections, a proximal end and a distal end. The proximal end of each pole is attached to the crown. The distal end of each pole is attached to a corresponding end connector. The multiple joints facilitate quickly pitching or striking the tent. The frame and the cloth housing are connected together so pitching the tent only requires erecting the frame. Moreover, the cloth housing and the frame are stored and transported together so the user will not lose or forget to take either the cloth housing or the frame.

Further benefits and advantages of the present invention will become apparent after a careful reading of the detailed description with appropriate reference to the accompanying drawings.

DETAILED DESCRIPTION OF THE INVENTION

Figure 1:
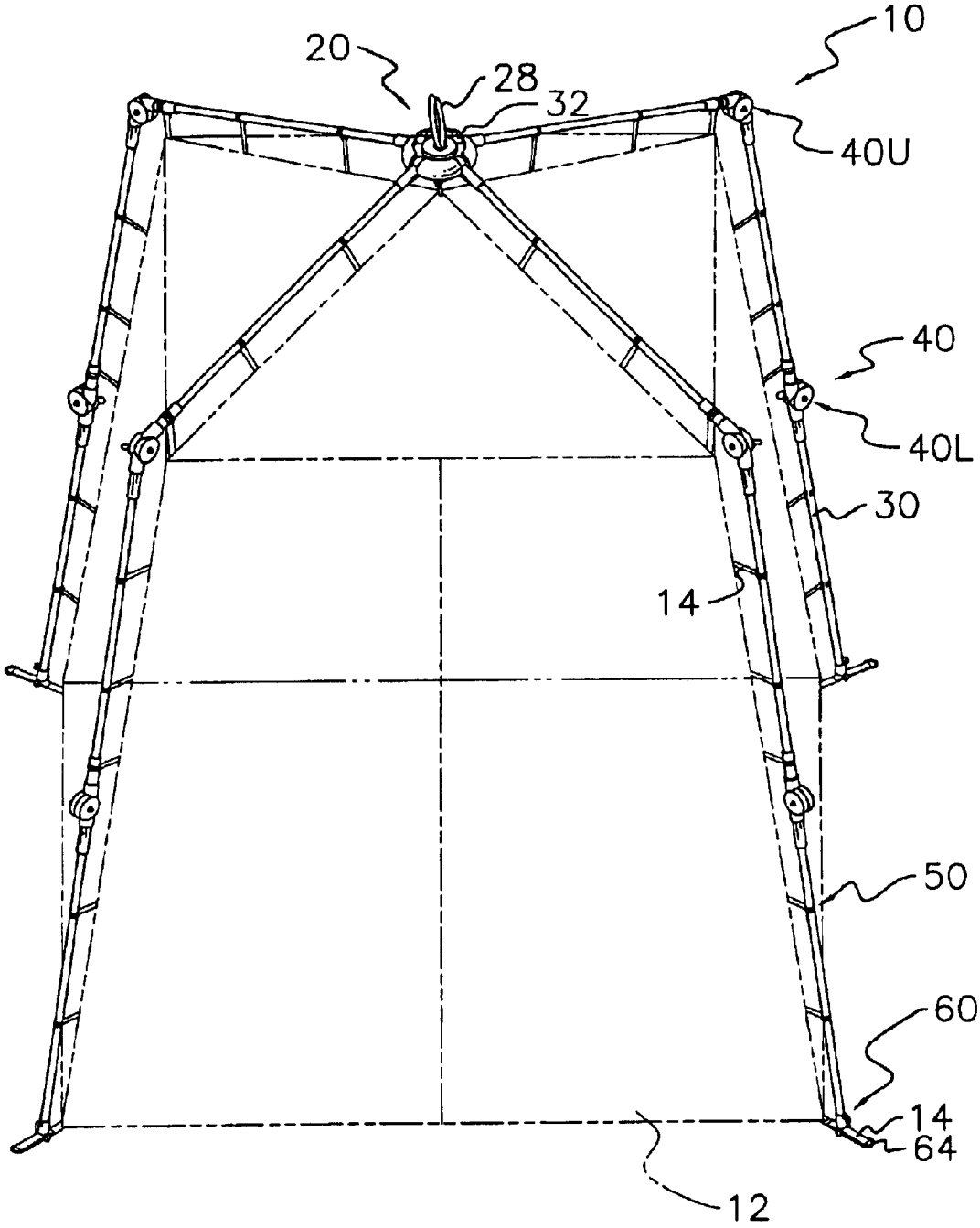
FIG. 1 is a perspective view of a quick-pitch/strike tent in accordance with the present invention.
Figure 2:
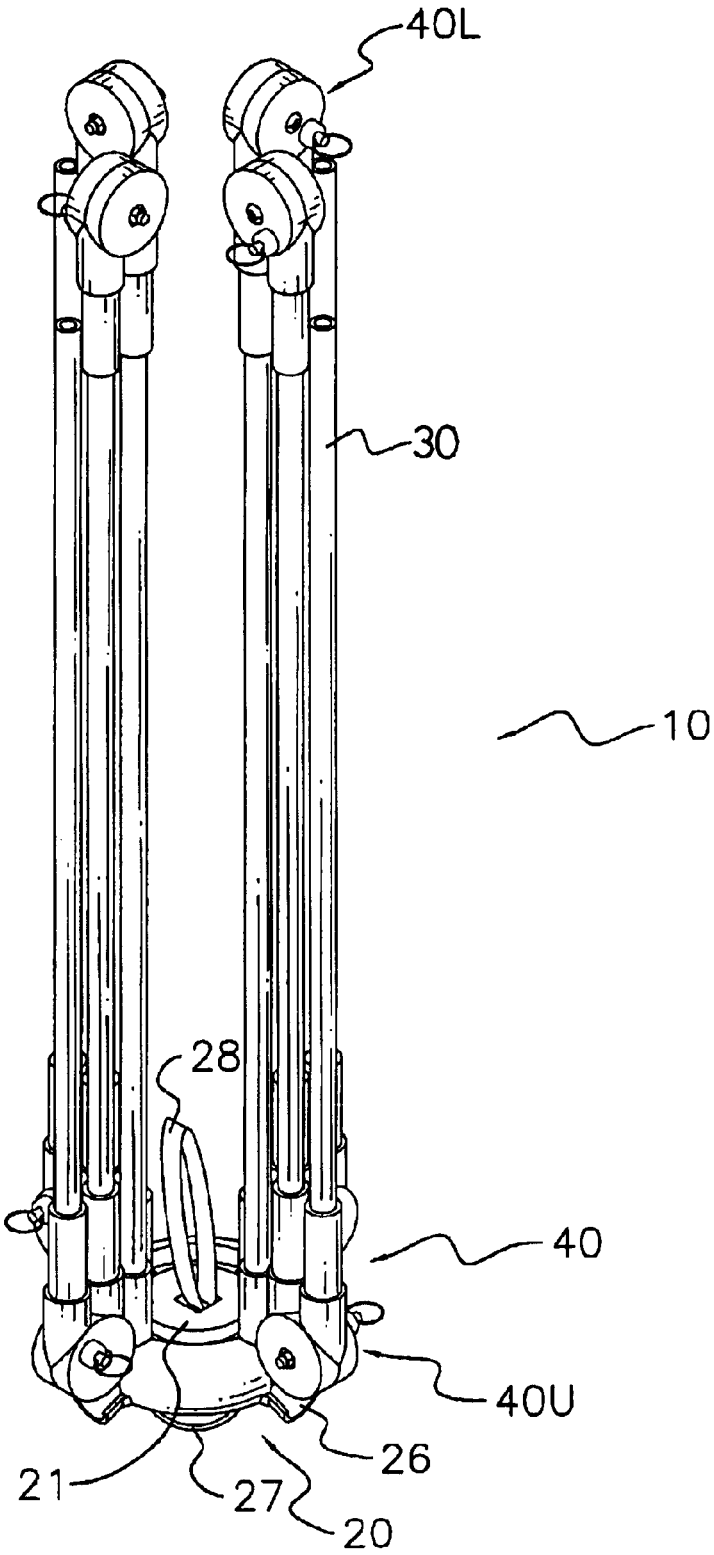
FIG. 2 is a perspective view of a frame of the tent in FIG. 1 struck.
Figure 3:
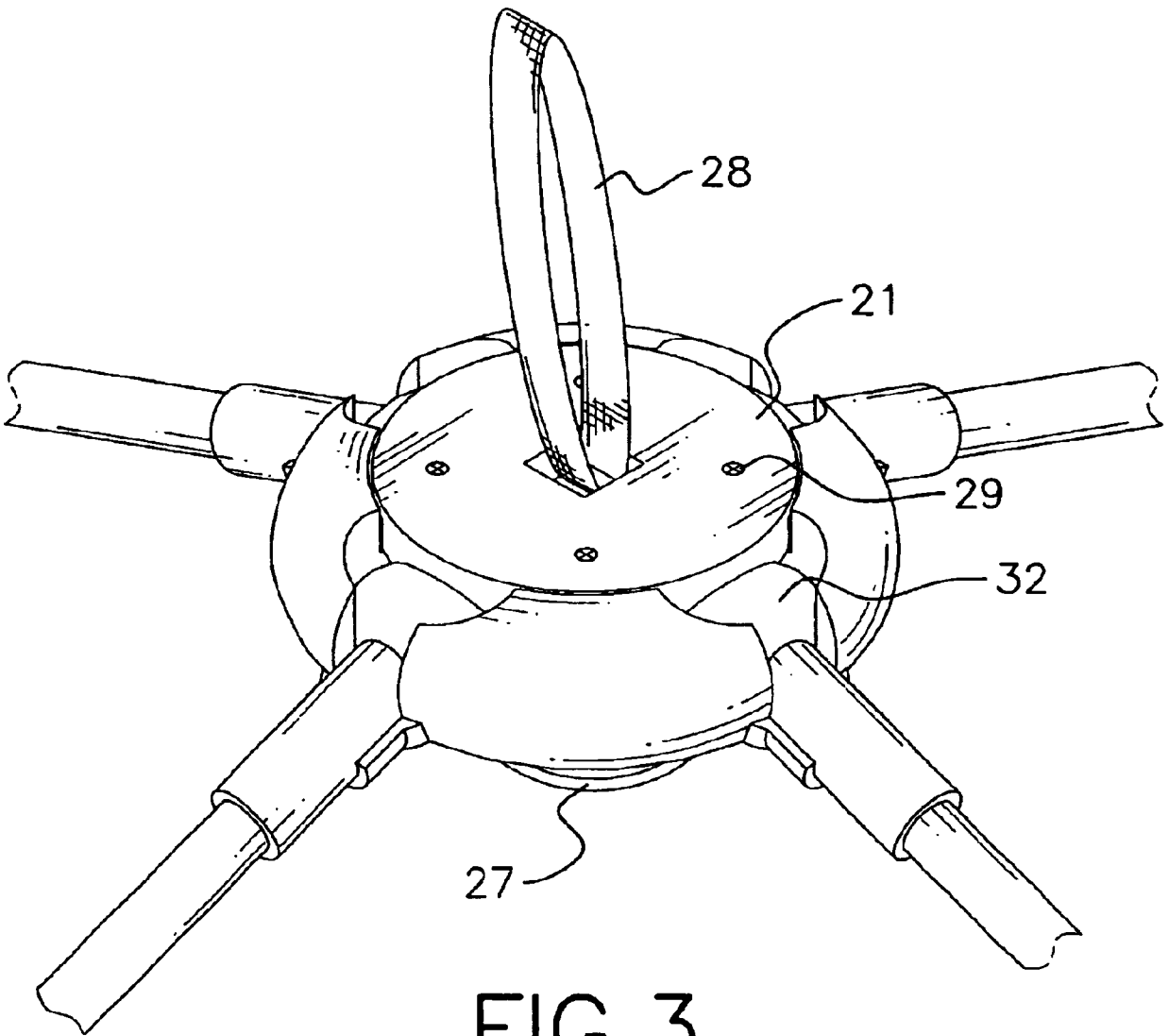
FIG. 3 is a perspective view of a crown and multiple poles of the tent in FIG. 1.
Figure 4:
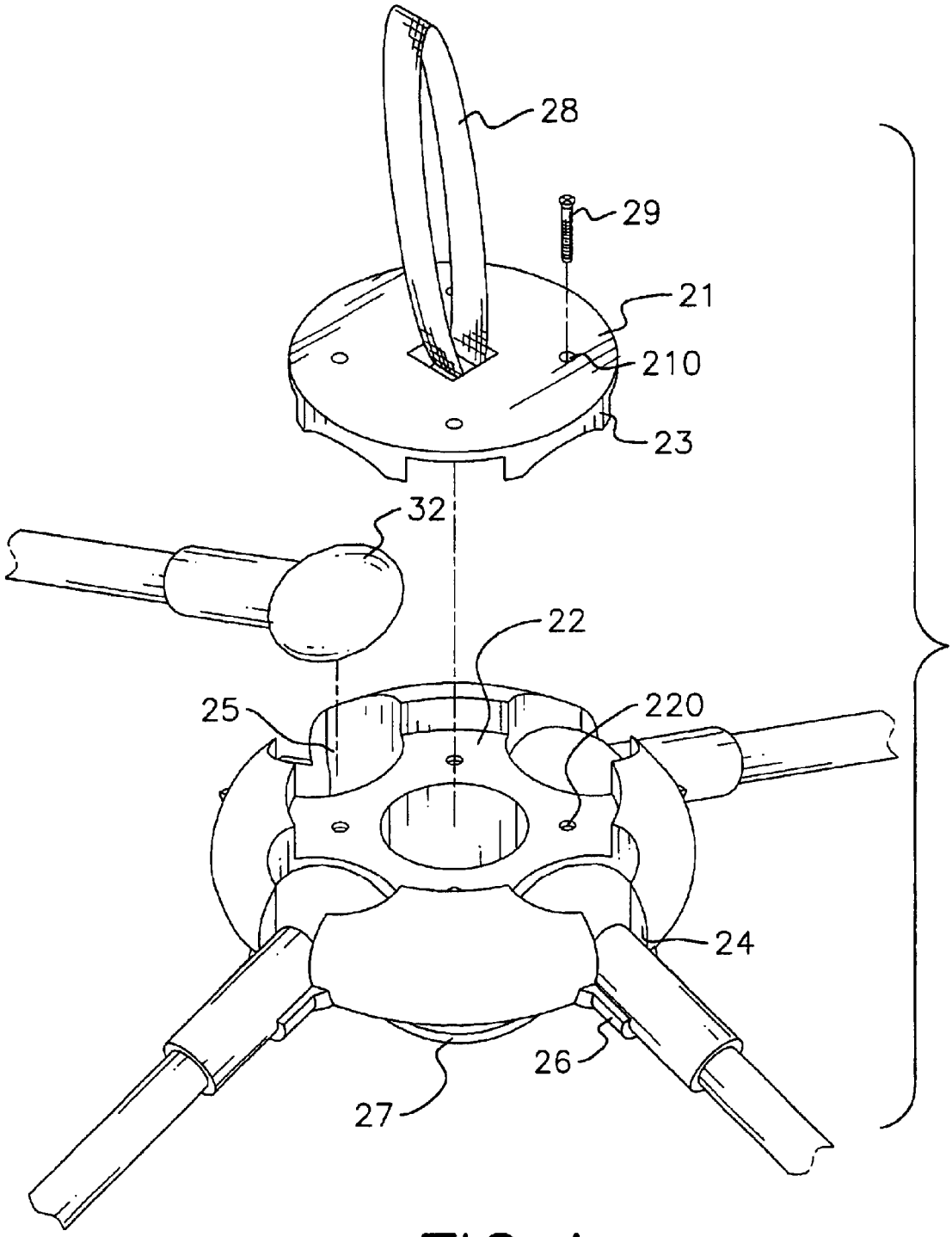
FIG. 4 is an exploded perspective view of the crown and multiple poles of the tent in FIG.3.
Figure 5:
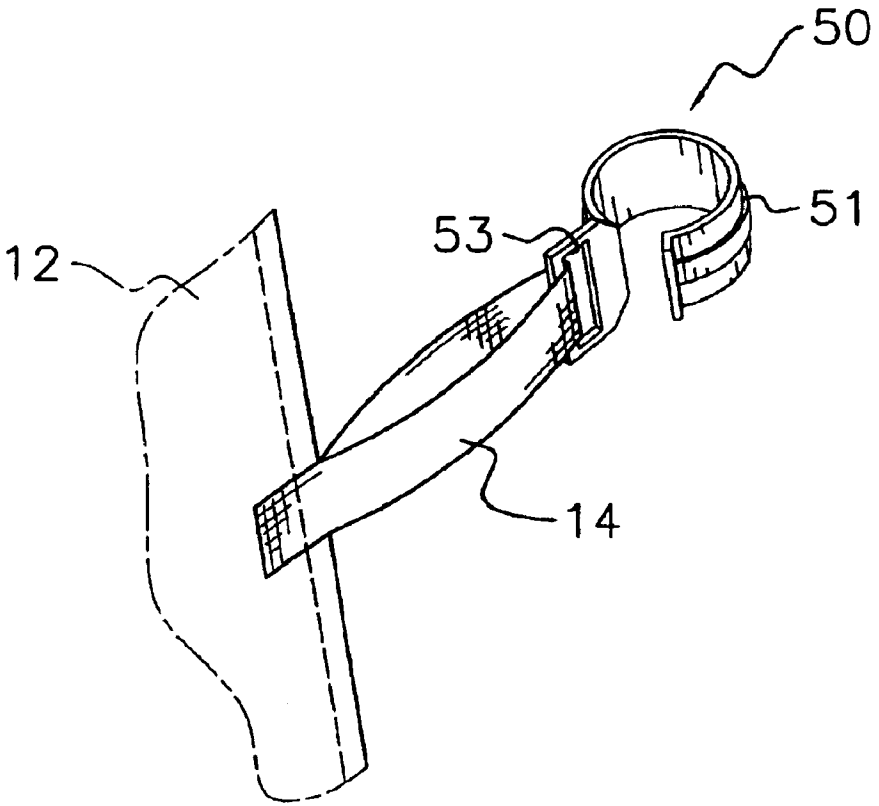
FIG. 5 is a perspective view of a clip connected to a cloth housing of the tent in FIG. 1.
Figure 6:
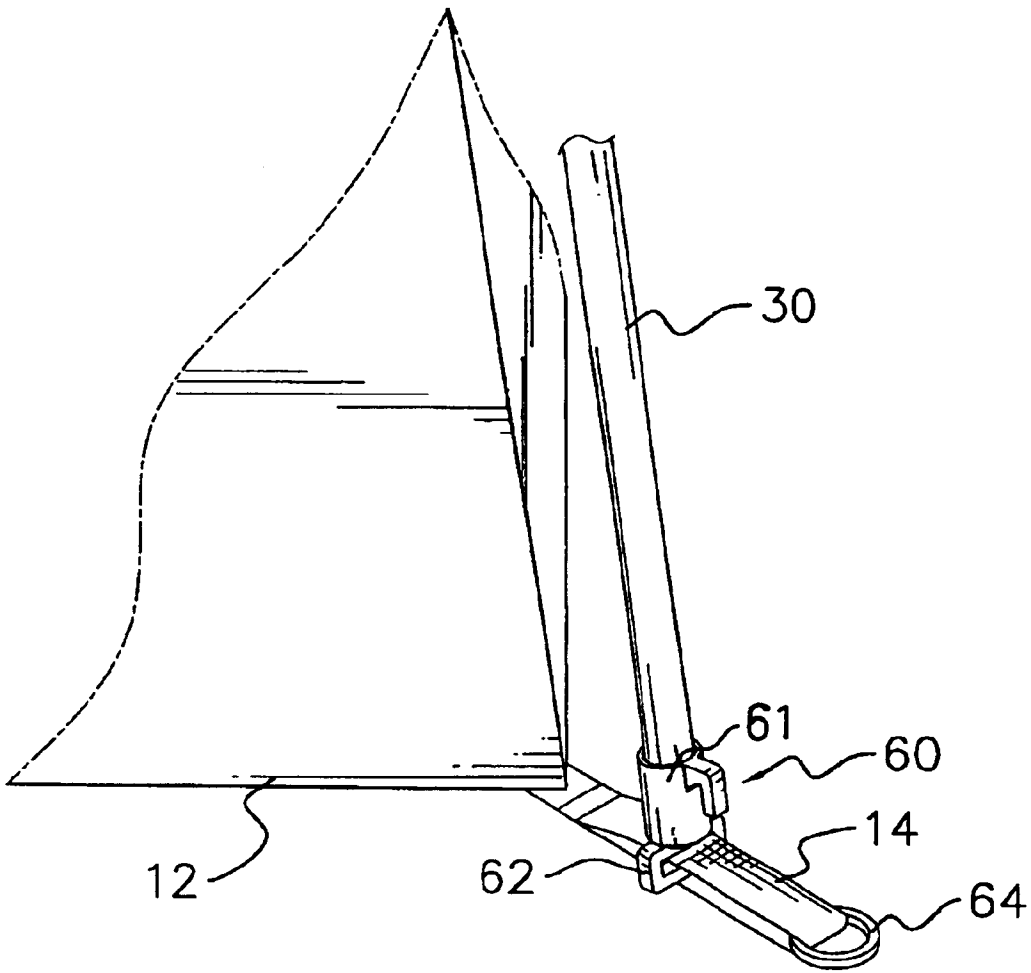
FIG. 6 is a perspective view of an end connector in FIG. 1 connected to a flexible loop the floor of the tent.

With reference to FIG. 1, a quick-pitch/strike tent in accordance with the present invention comprises a frame (10) and a cloth housing (12). The cloth housing (12) is suspended on the frame (10) and has a canopy (not numbered), a floor (not shown), multiple flexible loops (14), multiple cups (50) and multiple end connectors (60). The canopy has a roof (not numbered), multiple walls (not numbered) and multiple seams (not numbered). The roof has multiple panels (not numbered) and a central peak (not numbered) and is attached to the multiple walls. The floor has multiple corners (not numbered) and is attached to the canopy. The flexible loops (14) are attached to the central peak, the seams and the corners of the floor of the cloth housing (12). With further reference to FIG. 5, each clip (50) has a resilient clip (51) and an eye (53). Each flexible loop (14) on the seams of the cloth housing (12) and at the peak of the central peak of the canopy passes through the eye (53) of a clip (50). With further reference to FIG. 6, each end connector (60) has an end cap (61) and an eye (62). The flexible loop (14) at each corner of the floor has a D-ring (64) and passes through the eye (62) of an end connector (60). The D-ring (64) is used to anchor the tent to the ground.

With reference to FIGS. 1, 2, 3 and 4, the frame (10) comprises a crown (20) and multiple poles (30). The crown (20) is a flattened sphere and has a top plane (22), a bottom plane (not numbered), a curved outer edge (not numbered), a clip ring (27) and a top cap (21). The top plane (22) has a center (not numbered) and multiple threaded holes (220) around the center of the top plane (22). The curved outer edge of the crown (20) has multiple slots (24) with corresponding sockets (25). Each slots (24) is ellipsoidal and has a bottom (not numbered) and a lower positive limit (26) extending from the bottom of each slot (24). The lockable clip on the flexible loop (14) at the central peak of the cloth housing (12) is attached to the clip ring (27) on the bottom of the crown (20) to connect the cloth housing (12) to the crown (20). The top cap (21) has a center (not numbered), multiple through holes (210), multiple upper positive limits (23), a flexible handle (28) and multiple fasteners (29). The multiple through holes (210) correspond to the threaded holes (220) in the top plane (22). Multiple fastener (29), which may be multiple Bolts, respectively pass through the through holes (210) and screw into the threaded holes (220) to attach the top cap (21) to the top plane (22). The multiple upper positive limits (23) extend perpendicular from the top cap (21) and respectively correspond to the sockets (25). The flexible handle (28) attached to the center of the top cap (21) is used to raise or lower the crown (20) conveniently.

Each pole (30) comprises multiple joints, multiple sections (not numbered) and an end cap (not numbered) and has a distal end (not numbered) and a proximal end (not numbered). The joints in each pole (30) include at least one 180° joint (40L) and at least one obtuse joint (40U). The end caps (not numbered) have an integral crown joint (32) and are respectively mounted on and extend out from the proximal ends of the poles (30). The end cap on the proximal end of each pole is mounted in a slot (24) so the end cap on each pole (30) abuts the lower positive limit (26) when the frame (10) is extended. The crown joint (32) on each end cap is ellipsoidal and pivotally mounted in the socket (25) corresponding to the slot (24), and pivots between the upper positive limit (23) and the lower positive limit (26). The joints (40U, 40L) are mounted between and connect adjacent sections of the poles (30). The resilient clips (51) on the clips (50) are clipped onto the poles (30) to connect the cloth housing (12) to the poles (30).

The distal end of each pole (30) is mounted in the end cap (61) of the corresponding end connector (60).

Figure 7:
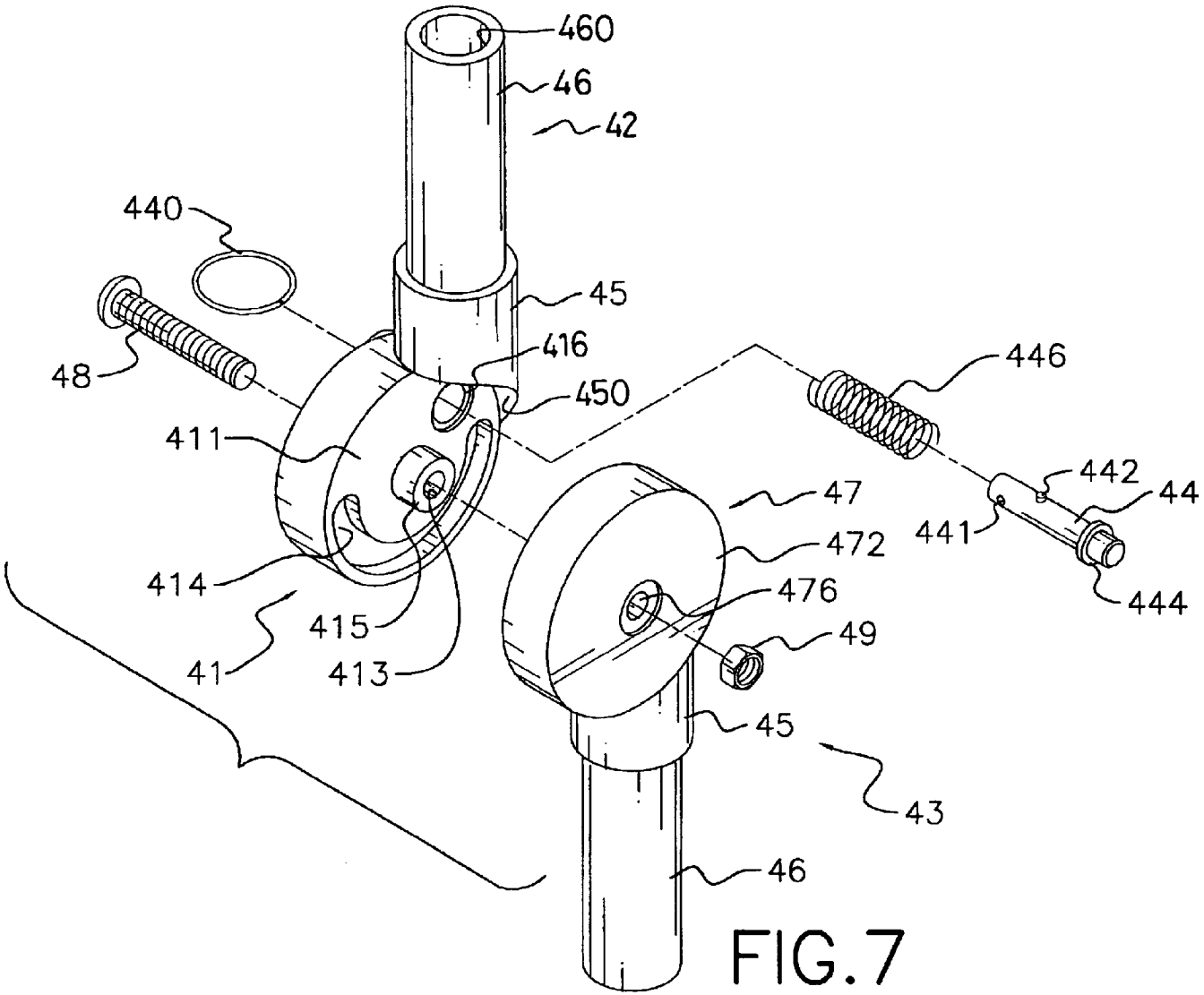
FIG. 7 is an exploded perspective view of a joint of the frame in FIG. 1.
Figure 8:
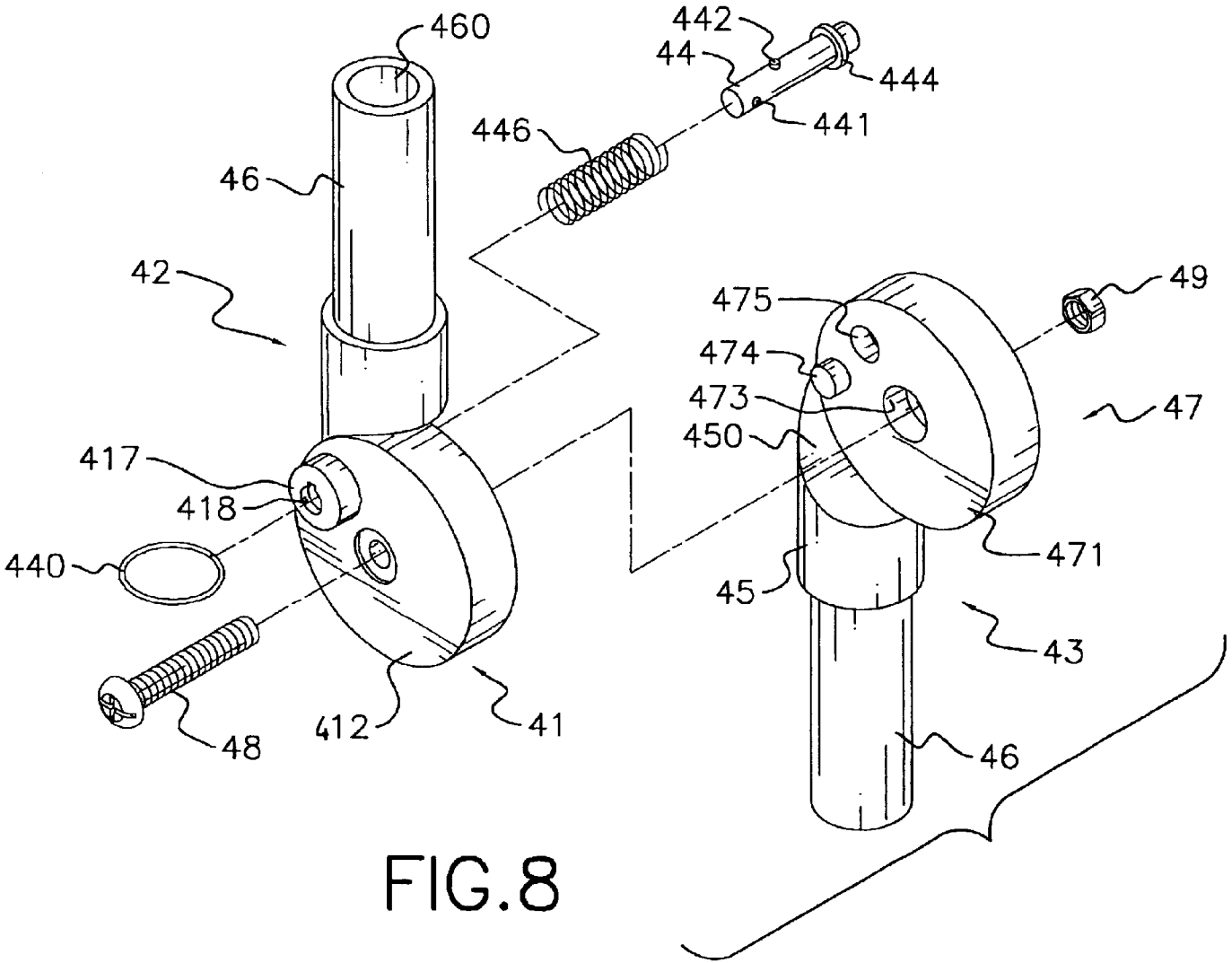
FIG. 8 is an exploded perspective view of the joint of the joint in FIG. 7 from another angle.

With reference to FIGS. 7 and 8, each joint (40) in the poles (30) comprises a male leaf (42), a female leaf (43), a lock (44) and a pivot fastener. The male leaf (42) comprises a male head (41), a shank (45) and an attachment sleeve (46), and the female leaf (43) comprises a female head (47), a shank (45) and an attachment sleeve (46).

The male head (41) is a disk and has an outer edge (not numbered), an inside face (411), an outside face (412), a central pivot hole (413), a concentric arched limit groove (414), a central cylindrical protrusion (415), a keyhole (416) and a locking protrusion (417). The inside face (411) and the outside face (412) are circular and have a center. The central cylindrical protrusion (415) is formed at the center of the inside face (411). The central pivot hole (413) passes through the center of the outside face (412), the inside face (411) and the central cylindrical protrusion (415). The concentric arched limit groove (414) is an arc, has a pitched end (not numbered) and a struck end (not numbered) and is concentric with the center of the inside face (411). In the 180° joint (40L), the arc is 180°, and in the obtuse joint (40U), the arc is a number of degrees equal to the angle of the angle between a wall and the roof of the canopy when the tent is erected, such as 120° or 135°. The keyhole (416) is formed between the pitched end of the concentric arced limit groove (414) and the shank (45) and passes through the outside face (412) and the inside face (411) of the male head (41). The locking protrusion (417) is formed on the outside face (412) concentric with the keyhole (416) and has an end, and a keyway (418) is formed in the keyhole (416) and the locking protrusion (417).

The female head (47) is a disk and has an outer edge (not numbered), an inside face (471), an outside face (472), a central hole (476), a limit stub (474), a lock hole (475) and a central countersink (473). The inside face (471) and the outside face (472) are circular and have a center. The central countersink (473) passes through the center of the inside face (471) and coaxially communicates with the central hole (476) that passes through the outside face (472). The central hole (476) has a radius smaller than the central countersink (473).

Figure 9:
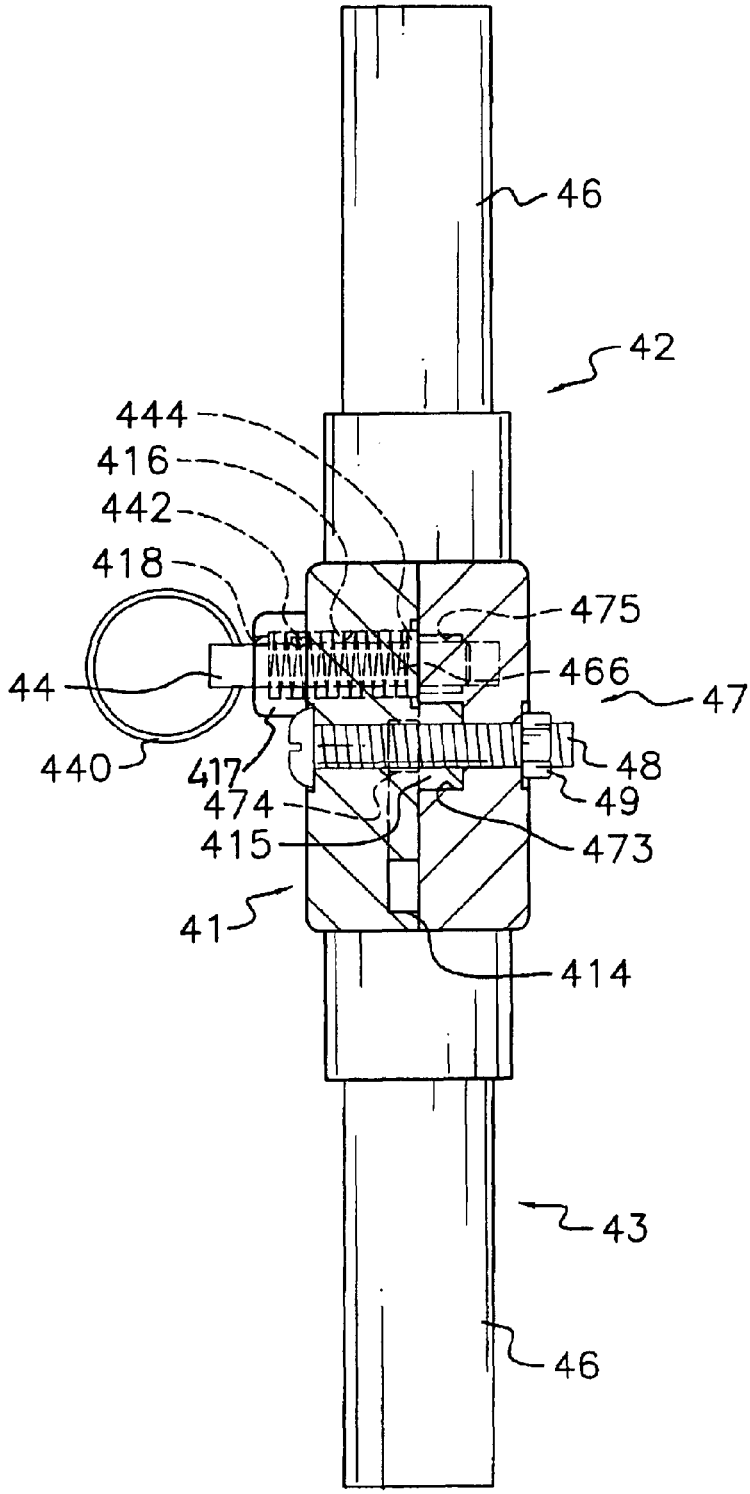
FIG. 9 is a front plan view in partial section of the joint in FIG. 7.
Figure 10:
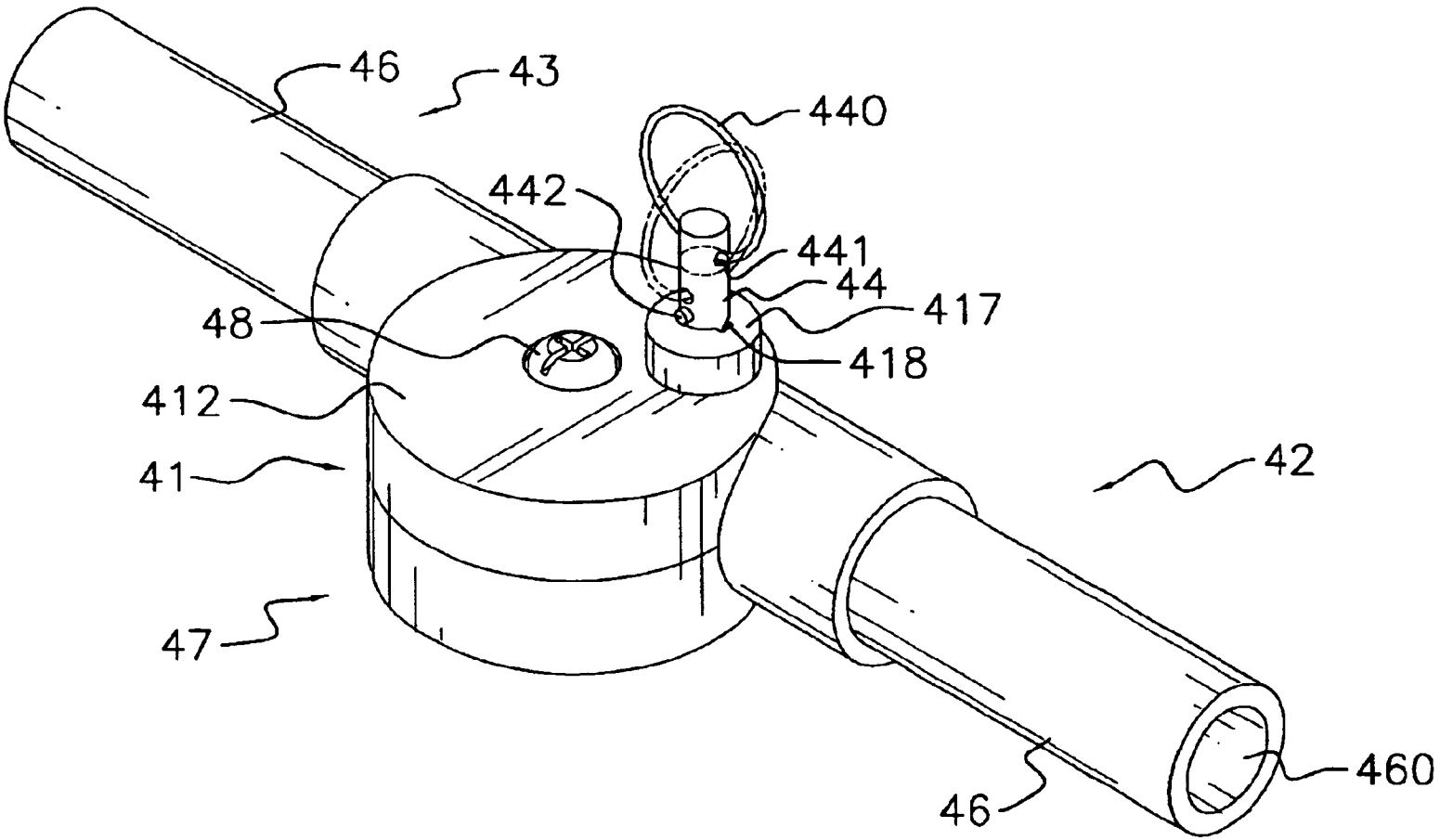
FIG. 10 is an operational perspective view of the joint in FIG. 7 with a pull ring turned.
Figure 11:
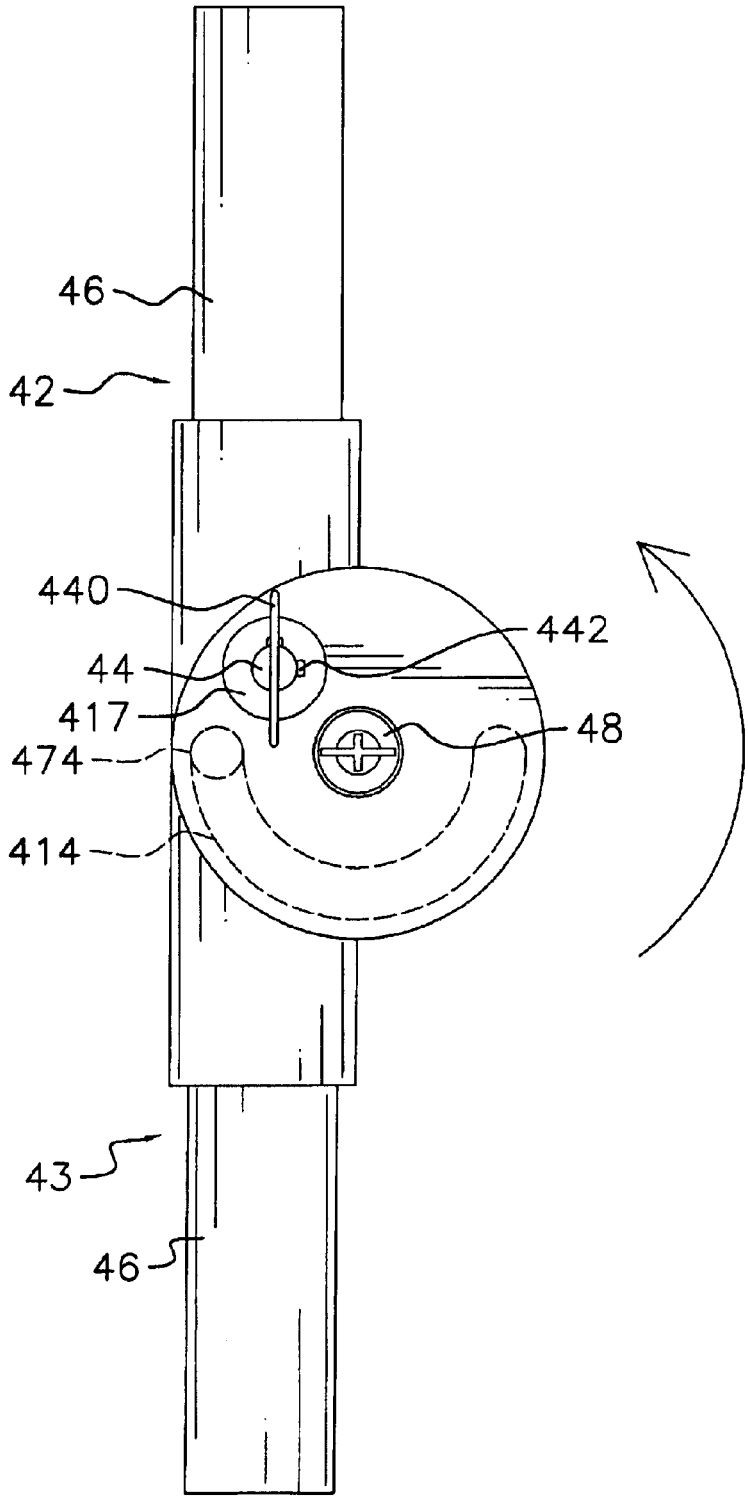
FIG. 11 is a side plan view of the joint in FIG. 7 in a pitched state.
Figure 12:
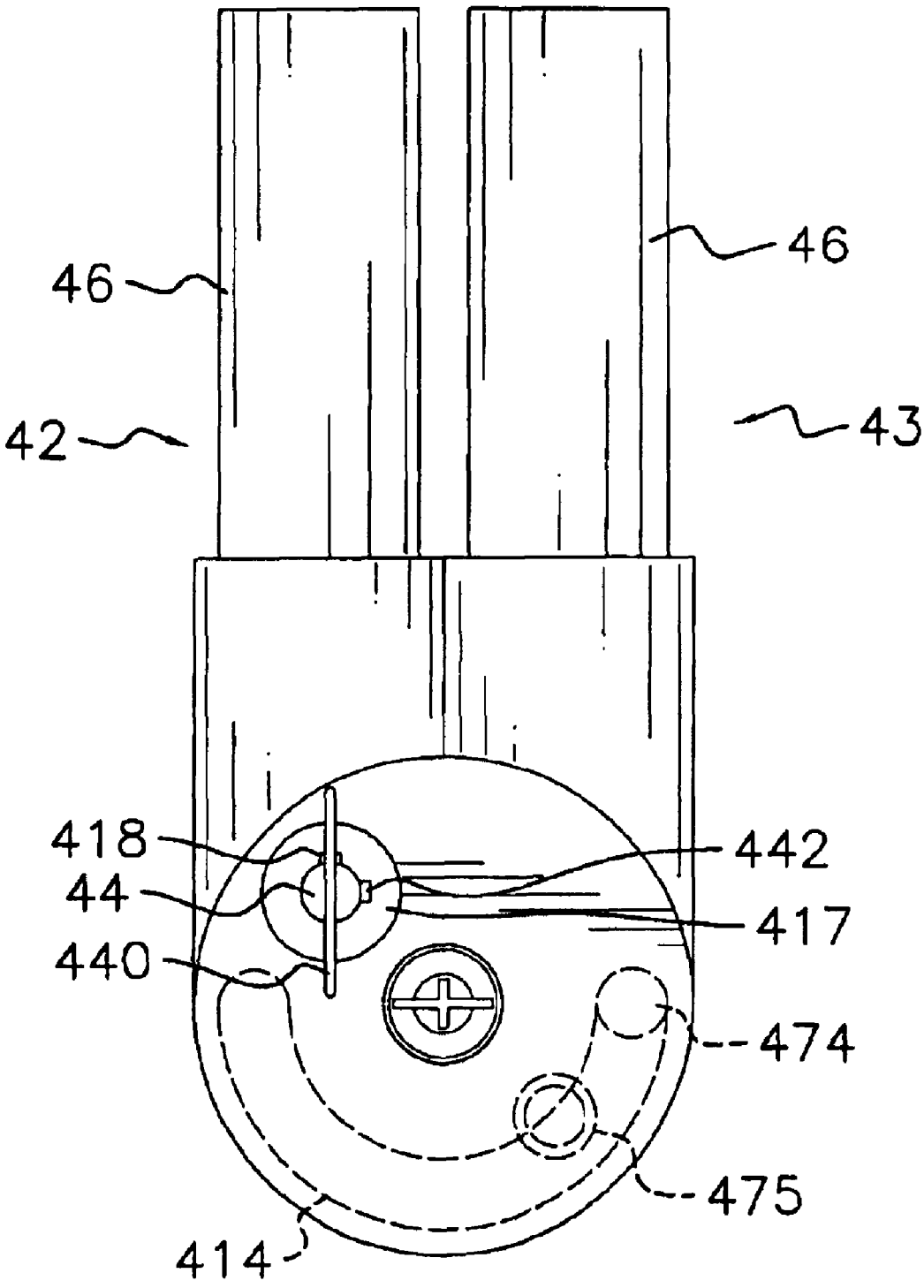
FIG. 12 is a side plan view of the joint in FIG. 7 in a struck state.

With further reference to FIG. 9, the central cylindrical protrusion (415) on the inside face (411) of the male head (41) is mounted in the central countersink (473) in the inside face (471) of the female head. The central pivot hole (413) through the male head (41) and the central cylindrical protrusion (415) corresponds to the central hole (476) through the female head (47). The pivot fastener passes through the central pivot hole (413) and the central hole (476), holds the male head (41) and the female head (47) together and allows the male leaf (42) and the female leaf (46) to pivot relative to each other. The pivot fastener may be a bolt (48) and a nut (49), a rivet (not shown), a pivot pin secured with a cotter pin (not shown), etc. The bolt (48) has a proximal end (not numbered), a distal end (not numbered), an enlarged head (not numbered) on the proximal end and a threaded shaft (not numbered). The nut (49) is screwed onto the threaded shaft of the bolt at the distal end. The limit stub (474) is formed off-center in the inside face (471) of the female head (47) and is mounted in the concentric arched limit groove (414) in the male head (41). The lock hole (475) is formed in the inside face (471) of the female head (47) near the limit stub (474). In the 180° joint (40L), the lock hole (475) corresponds to the keyhole (416) when the attachment sleeves (46) of the male and female leaves (42, 43) are axially aligned. In the obtuse joint (40U), the lock hole (475) corresponds to the keyhole (416) when the attachment sleeves (46) of the male and female leaves (42, 43) form an angle the same as the angle between the roof and walls of the canopy.

Each shank (45) is a hollow cylinder and has a central longitudinal axis (not numbered), an outer surface (not numbered), a proximal end (450) and a distal end (not numbered). The proximal end (450) of a shank (45) is integrally formed with the outer edge of the corresponding head (41, 47), and the outside surface extends tangentially from the outer edge of the corresponding head (41, 47). The central longitudinal axis is aligned with the inside face (411, 471) of the corresponding head (41, 47). The attachment sleeve (46) is hollow, has a longitudinal axis (not numbered) and an internal channel (460) and is formed integrally with and extends axially from the distal end of the shank (45). A pole (30) is securely mounted in the internal channel (460) to connect the joint (40) to the pole (30).

The lock (44) is a cylindrical rod (not numbered) with a locking end (not numbered) and an actuating end (not numbered) and comprises a transverse diametric hole (441), a key (442), an annular flange (444), a pull ring (440) and a spring (446). The transverse diametric hole (441) is formed near the actuating end of the lock (44), and the annular flange (444) is formed integrally with and extends radially from the lock (44) rear the locking end. The key (442) is cylindrical and protrudes radially from the lock (44) between the transverse diametric hole (441) and the annular flange (444). The spring (446) is mounted around the lock (44) between the annular flange (444) and the end of the locking protrusion (417). With further reference to FIG. 9, the spring (446) is mounted around the lock (44) from the actuating end, and the spring (446) and the actuating end of the lock (44) are inserted into the keyhole (416) before the male leaf (42) is pivotally attached to the female leaf (46). The actuating end of the key (44) protrudes from the end of the locking protrusion (417), and the spring (446) is held between the annular flange (444) and the end of the locking protrusion (417). After the key (44) and the spring (446) are inserted into the keyhole (416), the pull ring (440) is inserted through and mounted in the transverse diametric hole (441).

With reference to FIGS. 9 to 12, the joints (40L, 40U) in the poles (30) are pivoted from a struck position to a pitched position to erect the frame (10) and pitch the tent. The pull ring (440) is turned to align the key (442) with the keyway (418), so the lock (44) moves freely in the keyhole (416). When the keyhole (416) is not aligned with the lock hole (475), the lock (44) is held in the keyhole (416) by the inside face (471) of the female head (47). When the joints (40L, 40U) in the poles (30) are fully pivoted, the limit stub (474) is slid to the pitched end of the arced limit groove (414) and the key (44) aligns with and is pushed into the lock hole (475) by the spring (446). The key (44) in the lock hole (475) keeps the male leaf (42) and the female leaf (46) from pivoting.

When the frame (10) is struck, pulled the pull ring (440) let the lock (44) to leave the lock hole (475) of the female leaf (46). Turned the pull ring (440) let the key (442) not corresponded to the key groove (418) of the locking protrusion (417), and then let the lock (44) located on the top of the locking protrusion (417). The male leaf (42) and the female leaf (46) are pivoted from the pitched position to the struck position, and the limit stub (474) is slid to the struck end of the arced limit groove (414).

Figure 13:
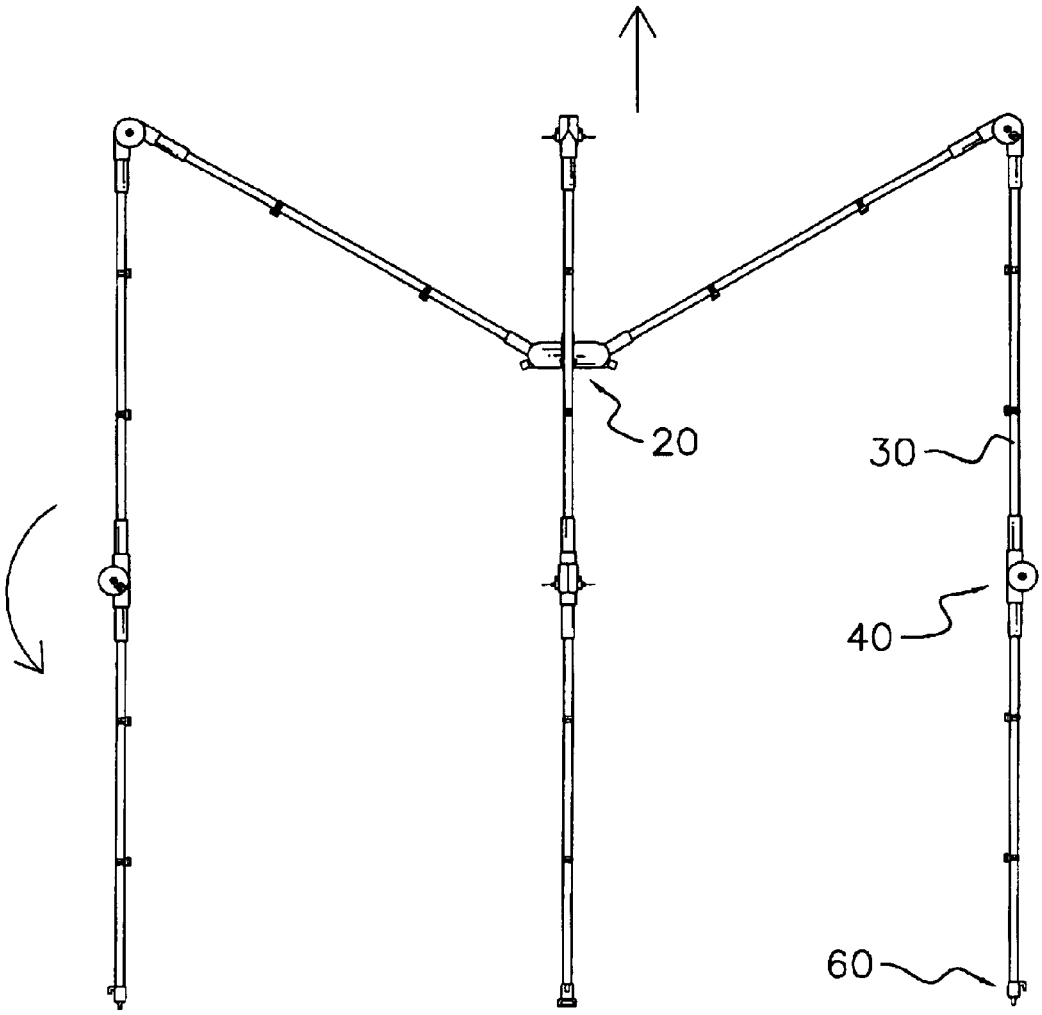
FIG. 13 is an operational side plan view of the frame of the tent being pitched.

With reference to FIGS. 1 and 13, each pole (30) of the frame (10) for a tent, which have three sections, a top section, a middle section and a bottom section, has a 180° joint (40L) and an obtuse joint (40U) between the distal end and the proximal end. With reference to FIGS. 9 to 13, a person who wants to pitch the struck tent first pulls and turns the pull rings (440) to align the keys (442) on the locks (44) with the keyways (418) in the keyholes (416). Then the bottom sections of the poles (30) are pivoted until the spring (446) pushes the lock (44) into the lock hole (475) to secure the male leaf (42) and the female leaf (46) between the bottom and middle sections of the poles (30). Then the crown (20) is pulled upward by the flexible handle (28) to pivot the upper sections until the springs (446) push the locks (44) of the obtuse joints (40U) into the respective lock holes (475). Pegs (not shown) is driven through the respective D-rings (64) on the flexible loops (14) at each corner of the floor of the cloth housing (12) to anchor the tent to the ground, which completes pitching the tent if the cloth housing (12) has been previously attached to the frame (10).

To attach the cloth housing (12) to the frame (10), the distal ends of the poles (30) of the erected frame (10) are first inserted into the respective end caps (61) of the end connectors (60). Then the lockable clip on the flexible loop (14) at the central peak of the cloth housing (12) is attached to the clip ring (27) on the bottom of the crown (20). Finally, the resilient clips (51) on the clips (50) are connected to the corresponding sections of the poles (30). With the cloth housing (12) attached to the frame (10), the tent is convenient to pitch, strike, store and transport.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A quick-pitch/strike tent comprising a frame and a cloth housing, wherein:

the frame comprises a crown and multiple poles pivotally connected to the crown, each pole with a distal end and a proximal end is composed of multiple sections and a joint mounted between each pair of adjacent sections;

wherein each joint in the poles comprises a male leaf, a lock and a female leaf, where the male leaf and the female leaf are held together and pivot relative to each other and wherein the male leaf comprises a male head and an attachment sleeve formed under the male head, and the female leaf comprises a female head and an attachment sleeve formed under the female head;

wherein the male head is a disk and has an outer edge, an inside face, an outside face, a concentric arched limit groove, a keyhole and a locking protrusion, wherein the inside face and the outside face are circular and have a center;

the concentric arched limit groove is an arc, has a pitched end and a struck end and is concentric with the center of the inside face;

the keyhole with an inner surface is defined through the male leaf at a position between the pitched end of the concentric arced limit groove and the attachment sleeve;

the locking protrusion is formed on the outside face concentric with the keyhole and has an end, and a keyway is formed in the inner surface of the keyhole and the locking protrusion;

the female head is a disk and has an outer edge, an inside face, an outside face, a limit stub and a lock hole, wherein the inside face and the outside face are circular and have a center;

the limit stub is formed off-center on the inside face of the female head and is mounted in the concentric arched limit groove in the male head;

the lock hole is formed in the inside face of the female head near the limit stub;

the attachment sleeve is hollow, has an internal channel and a proximal end formed integrally with the outer edge of the corresponding head, and one of the sections of the corresponding one pole is securely mounted in the internal channel to connect the joint to the corresponding pole;

the lock is a cylindrical rod with a locking end and an actuating end and comprises a transverse diametric hole, a key, an annular flange, a pull ring and a spring, wherein the transverse diametric hole is formed near the actuating end of the lock;

the annular flange is formed integrally with and extends radially from the lock near the locking end;

the key is cylindrical and protrudes radially from the lock between the transverse diametric hole and the annular flange;

the spring is mounted around the lock between the annular flange and the end of the locking protrusion, and the spring and the actuating end of the lock are inserted into the keyhole;

the pull ring is inserted through and mounted in the transverse diametric hole;

the cloth housing is suspended on the frame and has a canopy having a roof, multiple walls and multiple seams, where the roof has multiple panels and a central peak with a peak and is attached to the multiple walls at a specific angle;

a floor having multiple corners and attached to the canopy; and multiple flexible loops attached to the central peak, the seams and the corners of the floor of the cloth housing are connected to the poles.

2. The quick-pitch/strike tent as claimed in claim 1, wherein the cloth housing has a lockable clip securely attached to the flexible loop at the peak of the central peak of the canopy and connected to the crown to connect the cloth housing to the crown.

3. The quick-pitch/strike tent as claimed in claim 2, wherein the crown has a top plane, a bottom plane, a curved outer edge, a clip ring, a top cap and multiple crown fasteners, wherein the top plane has a center and multiple threaded holes around the center of the top plane;

the curved outer edge has multiple slots and a socket corresponding to and communicating with each respective slot, and each slot has a bottom and a lower positive limit extending from the bottom of the slot;

the clip ring is formed on the bottom of the crown and the clip on the flexible loop at the central peak of the cloth housing is attached to the clip ring to connect the cloth housing to the crown;

the top cap has a center, multiple through holes and multiple upper positive limits, wherein the multiple through holes respectively correspond to the threaded holes in the top plane;

the multiple upper positive limits extend perpendicular from the top cap and respectively correspond to the sockets; and the crown fasteners respectively pass through the through holes and screw into the threaded holes to attach the top cap to the top plane.

4. The quick-pitch/strike tent as claimed in claim 3, wherein the crown is a flattened sphere.

5. The quick-pitch/strike tent as claimed in claim 3, wherein each crown fastener is a bolt.

6. The quick-pitch/strike tent as claimed in claim 3, wherein each pole comprises an end cap with an integral crown joint mounted on and extend out from the proximal end of the pole, and the end cap on the proximal end of each pole is mounted in one of the slots in the crown, and the crown joint on each end cap is pivotally mounted in the socket corresponding to the slot and pivotally held between the corresponding one of the upper positive limits and the corresponding lower positive limit.

7. The quick-pitch/strike tent as claimed in claim 6, wherein the crown joint on each end cap is ellipsoidal.

8. The quick-pitch/strike tent as claimed in claim 6, wherein each slot in the crown is ellipsoidal.

9. The quick-pitch/strike tent as claimed in claim 3, wherein a flexible handle is attached to the center of the top cap of the crown and is adapted to move the crown conveniently.

10. The quick-pitch/strike tent as claimed in claim 1, wherein the cloth housing has multiple clips each having a resilient clip and an eye respectively attached to the flexible loops at the seams and the corners of the floor, and each flexible loop on the seams of the cloth housing passes through the eye of a corresponding one of the clips and the resilient clips on the clips are clipped onto the poles to connect the cloth housing to the poles.

11. The quick-pitch/strike tent as claimed in claim 1, wherein the joints in each pole include at least one 180° joint and at least one obtuse joint, where the 180° joint has an arc of 180°, and the obtuse joint has an arc a number of degrees equal to the angle between each wall and the roof of the canopy when the tent is erected, and the joints are mounted between and connect to adjacent sections of the poles, wherein the male leaf further comprises a shank formed between the female head and the attachment sleeve, and the female leaf further comprises a shank formed between the male head and the attachment sleeve, wherein each shank is a hollow cylinder and has a central longitudinal axis, an outer surface, a proximal end and a distal end, wherein the proximal end of each shank is integrally formed with the outer edge of the corresponding head;

the outside surface extends tangentially from the outer edge of the corresponding head;

the central longitudinal axis is aligned with the inside face of the corresponding head;

the attachment sleeve is formed integrally with and extends axially from the distal end of one of the shanks;

the male head further comprises a central pivot hole and a central cylindrical protrusion, wherein the central cylindrical protrusion is formed at the center of the inside face;

the central pivot hole passes through the center of the outside face, the inside face and the central cylindrical protrusion;

the female head further comprises a central hole and a central countersink, wherein the central countersink passes through the center of the inside face and coaxially communicates with the central hole that passes through the outside face, and the central cylindrical protrusion on the inside face of the male head is mounted in the central countersink in the inside face of the female head; and the central pivot hole through the male head and the central cylindrical protrusion corresponds to the central hole through the female head, and a pivot fastener passes through the central pivot hole and the central hole, holds the male head and the female head together and allows the male leaf and the female leaf to pivot relative to each other.

12. The quick-pitch/strike tent as claimed in claim 11, wherein the central hole in the female head has a radius slightly smaller than that of the central countersink in the female head.

13. The quick-pitch/strike tent as claimed in claim 11, wherein the pivot fastener comprises a bolt and a nut.

14. The quick-pitch/strike tent as claimed in claim 13, wherein the bolt has a proximal end, a distal end, an enlarged head on the proximal end and a threaded shaft, and the nut is screwed onto the threaded shaft of the bolt at the distal end.

15. The quick-pitch/strike tent as claimed in claim 11, wherein the pivot fastener is a rivet.

16. The quick-pitch/strike tent as claimed in claim 11, wherein the pivot fastener is a pivot pin secured with a cotter pin.

17. The quick-pitch/strike tent as claimed in claim 11, wherein the lock hole in each 180° joint corresponds to the keyhole when the attachment sleeves of the male and female leaves on the 180° joint are axially aligned.

18. The quick-pitch/strike tent as claimed in claim 11, wherein the lock hole in each obtuse joint corresponds to the keyhole when the attachment sleeves of the male and female leaves on the obtuse joint form an angle the same as the angle between the roof and walls of the canopy.

19. The quick-pitch/strike tent as claimed in claim 1, wherein the cloth housing has multiple end connectors each having an end cap and an eye and the flexible loop at one of the corners of the floor passes through the eye in the corresponding end connectors, and the distal end of each pole is mounted in the end cap of the corresponding end connector.

20. The quick-pitch/strike tent as claimed in claim 19, wherein the flexible loop at each corner of the floor has a D-ring and passes through the eye of the corresponding one of the end connectors, and the D-ring is adapted to anchor the tent to the ground.

* * * * *